United States Patent [19]

Banner

[11] Patent Number: 4,871,116

[45] Date of Patent: Oct. 3, 1989

[54] METHOD AND APPARATUS FOR PROPORTIONALLY ADDING MINUTE QUANTITIES OF AN ACTIVE INGREDIENT TO A FLOWING STREAM OF MATERIAL

[75] Inventor: Ralph W. Banner, Alberto, Canada

[73] Assignee: R. A. Tracer Service Ltd., Canada

[21] Appl. No.: 73,604

[22] Filed: Jul. 15, 1987

[30] Foreign Application Priority Data

Jul. 15, 1986 [CA] Canada ..... 513801

[51] Int. Cl.[4] ..... B02C 19/12

[52] U.S. Cl. ..... 241/21; 241/25; 241/63; 241/101.2

[58] Field of Search ..... 250/260; 166/250, 308; 241/30, 25, 101.2, 101 B, 260.1, 63, 15, 21

[56] References Cited

U.S. PATENT DOCUMENTS 4,199,680 4/1980 Moon ..... 250/260

4,712,618 12/1987 Handke et al. ..... 250/260 X

*Primary Examiner*—Mark Rosenbaum

*Attorney, Agent, or Firm*—Low, Price, LeBlanc, Becker & Shur

[57] ABSTRACT

A method and apparatus for adding minute quantities of radioactive material to frac material, acid material, cement squeezes, or the like, being pumped underground which includes providing a filler material or carrier having a minor portion of radioactive material distributed evenly therethrough, providing a lead shielded container having a variable volume chamber for the filler having the radioactive material and progressively decreasing the chamber volume at a predetermined rate to meter outflow of the filler with radioactive material from the container and into the line carrying the material being pumped underground. The rate of metering is such as to provide the desired concentration of radioactive material relative to the flow rate of material being pumped underground. The filler with the radioactive material is preferrably a solid plug and a grinder is used to progressively grind material at a selected rate from the leading end of the plug into particles of selected size.

15 Claims, 3 Drawing Sheets

METHOD AND APPARATUS FOR PROPORTIONALLY ADDING MINUTE QUANTITIES OF AN ACTIVE INGREDIENT TO A FLOWING STREAM OF MATERIAL

FIELD OF INVENTION

This invention relates generally to a method and apparatus for injecting minute quantities of an active ingredient, for example a radioactive material, into a flowing stream of material in proportion to the rate of flow of the material. The invention is particularly concerned with injecting radioactive material into oil/gas well stimulation processes and while the invention will be disclosed herein with reference thereto it is applicable to other fields of technology.

BACKGROUND OF INVENTION

In an oil field it is known to pump sand by way of a fluid (frac) into the ground in an oil well stimulation or fracturing process. The material is forced by pressure through a frac line by a primary pumper, i.e. the source where fluids, sand and chemicals are mixed or blended together, and it is desirable to know, but difficult to determine, the final destination of the material underground. To do this, a tracer element in minute quantities has been added to the frac material, i.e. a radioactive tracer element. There has not, however, been any means of providing a consistent concentration of the radioactive material relative to the frac material and, obviously, such lack of control makes it difficult to determine with any accurcy the final distribution and destination of the frac material underground.

The prior art procedure for adding the radio-active material consisted of having an individual pour, from a bottle using long handled tongs, radioactive sand into the fluid or sand before entering a mixer where the fluid and sand is mixed. This is not only dangerous for the one handling the material but also it fails to provide any degree whatsoever in the consistency of concentration. The amount of radioactive material per tonne of sand demanded varies from one customer to another and the common range is from 1 to 3 millicurries of radioactive material per tonne of sand. The sand is added to fluids being pumped. Determining what rate the sand is being added to the fluids being pumped is done by multiplying the rate per minute by the sand concentration, for example:

$$100\ \text{kg/m}^3 \times 3\ \text{m}^3/\text{min} = 300\ \text{kg/min or } 0.3\ \text{tonne.}$$

Some frac companies call for their fracs in the standard measuring system which, for example may be 3 lbs/gal and 18 barrels/min. From this it will be realized a very minute quantity of radioactive material is being added. The prior system used has a number of deficiencies which are quite severe and the most obvious are as follows:

(a) The bottle of material used by the individual is not all radioactive material. About 90–95% of the contents is filler so that the material can be poured slowly enough. This does not allow for a totally accurate trace as the radioactive material is not added consistently.

(b) Radioactive material is added with only an estimated accuracy as it is impossible to know how much actual radioactive material is being added with the filler and there is no way of accurately controlling how fast or slow the material is being added.

(c) Radioactive particles may become air-borne when being poured in windy conditions.

(d) Equipment being used has the possibility of becoming contaminated as the radioactive material passes through all the equipment (mixer and pumper) used for the job.

(e) Exposure to radioactive energy is much higher as there is no lead shielding incorporated and the length of time spent with the material can be quite extended. Where the material is being added there are always 2 to 6 workers subject to exposure.

(f) The location of personnel injecting the radioactive material is considered dangerous. Most disasters usually happen at the piece of equipment where the individual adding the radioactive material must be located.

(g) Contamination due to spillage is possible as once the cap of the bottle has been removed the contents are loose and can be spilled very easily.

SUMMARY OF INVENTION

An object of the present invention is to provide a safe means of adding a radioactive material to frac material in an oil field operation.

A further object of the present invention is to provide a method and apparatus of adding with a high degree of consistency a minute quantity of a radioactive tracer element to a frac material at a consistent rate over a period of time in proportion to the rate of frac material being pumped.

In keeping with these general objects and others there is provided in accordance with the present invention a method of adding minute quantities of radioactive material to frac material being pumped underground comprising providing a filler material having a minor portion of radioactive material distributed evenly therethrough, providing a lead shielded container for said filler and radioactive material, providing means to meter outflow of said filler and radioactive material from the container at a selected rate and directing said outflow of radioactive material into the frac material being pumped underground. In the preferred form the filler, having the radioactive material therein, is a solid plug and the means metering the outflow of filler and radioactive material is a grinder for progressively grinding material at a selected rate from the plug and means for feeding the ground up filler at a selected rate.

In accordance with a further aspect of the present invention there is provided a method of adding a tracer material to a flowing stream of material comprising (a) determining the flow rate of said stream of material;

(b) metering a filler material having a known minor quantity of radioactive material evently distributed therethrough at a rate dependent upon said flow rate to provide the desired concentration of radioactive material in the flowing material; and (c) injecting said filler having the radioactive material therein during metering thereof directly into the flowing stream at a location downstream from the source causing said stream to flow.

In accordance with a further aspect of the present invention there is provided apparatus for injecting minute quantities of a radioactive material into frac material being pumped underground comprising:

(a) a lead shielded chamber for holding a supply of filler material having a radioactive tracer element evenly distributed therethrough;

(b) means for progressively decreasing the volume of said chamber at a predetermined rate to meter outflow of the filler material with the radioactive tracer therein from said chamber; and (c) means for feeding the metered material into a line carrying the frac material.

LIST OF DRAWINGS

The invention is illlustrated by way of example with reference to the accompanying drawings wherein.

DESCRIPTION OF PREFERRED EMBODIMENT

Figure 1:
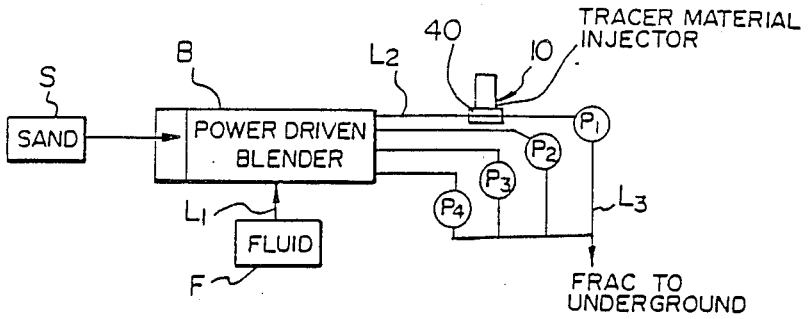
FIG. 1 is a schematic view of a frac pumping system incorporating a tracer element and injection system of the present invention.

In FIG. 1 there is schematically illustrated a frac pumping system commonly used in oil field operations. The system includes a source of fluid F, a source of sand S, a power driven blender B and a number of pumpers designated P1, P2, P3 and P4. The source of sand is normally a loaded dump truck which dumps its load directly into a hopper for the blender B. Fluid is drawn through line L1 from source F and the mixture (frac material) is pumped by the blender through a number of lines L2 to respective ones of a number of pumps P. The pressure in line L2 is normally about 150 PSIG. In accordance with the present invention, a radioactive tracer element is added to the frac material by an injector 10 downstream from the blender B. It is detachably connected, preferrably to one of the lines L2, and while connection could be made to line L3 for injection, and thus avoid any risk of contaminating pump P, the high pressure in such line makes it difficult to do and do so safely.

While the invention is described herein with reference to a fracturing operation, it is also applicable to acid jobs and cement squeezes in which cases a pressure pumper is used instead of blender B shown in the system of FIG. 1. Tie in the injector 10 in such case is made in line L1.

Figure 2:
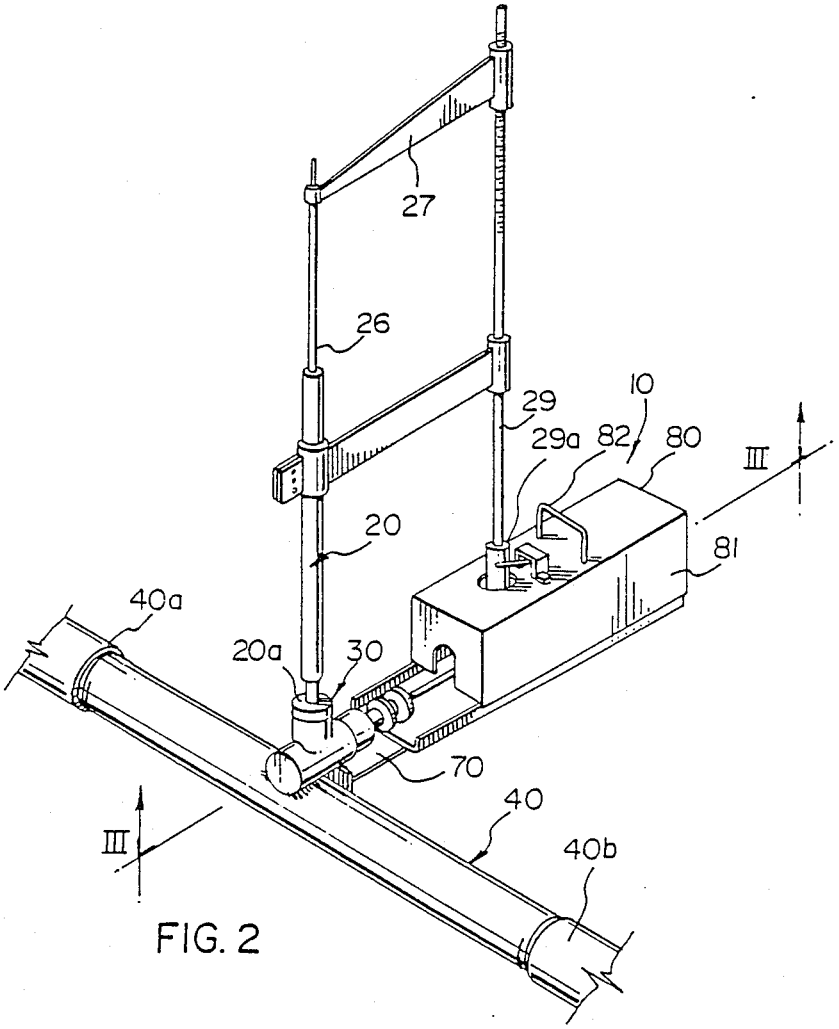
FIG. 2 is a diagrammatic perspective view of the injection tool provided in accordance with the present invention.
Figure 3:
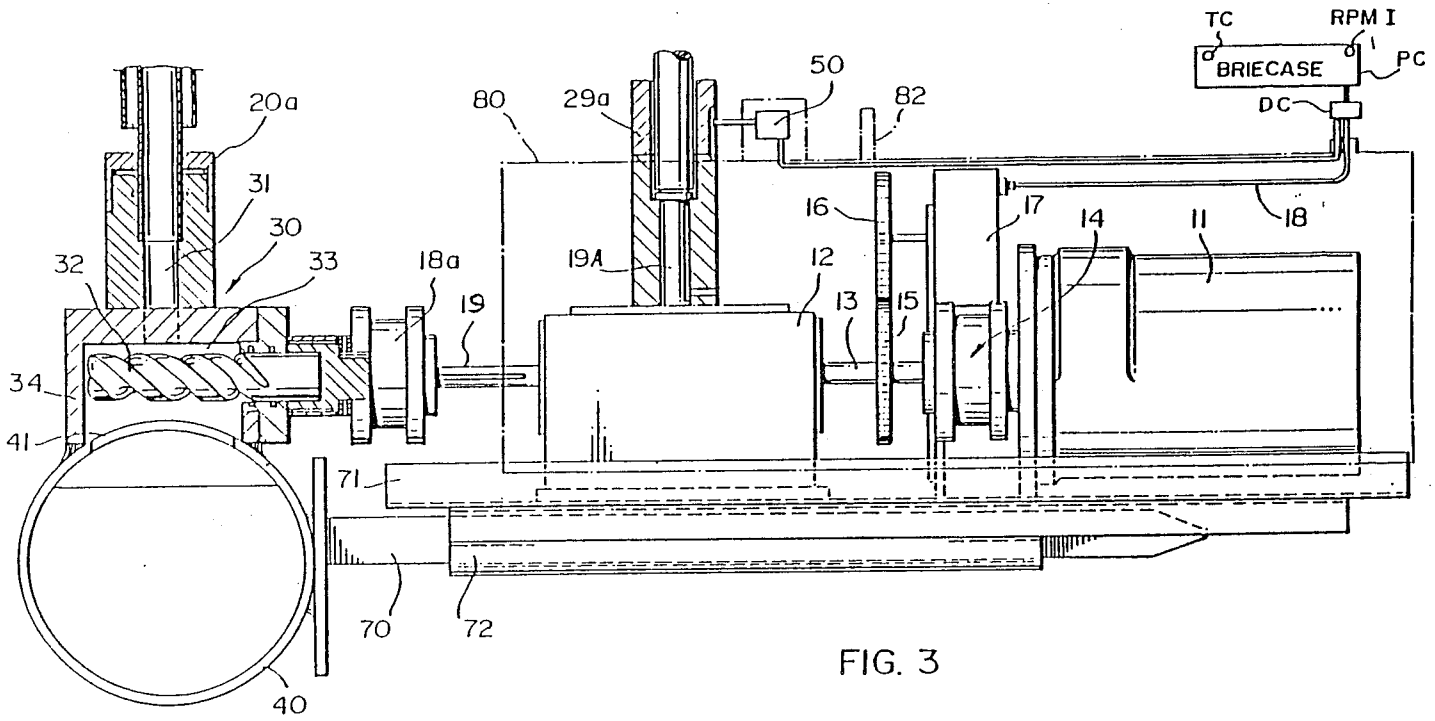
FIG. 3 is a cross-sectional view taken along essentially line 3—3 of FIG. 2.
Figure 4:
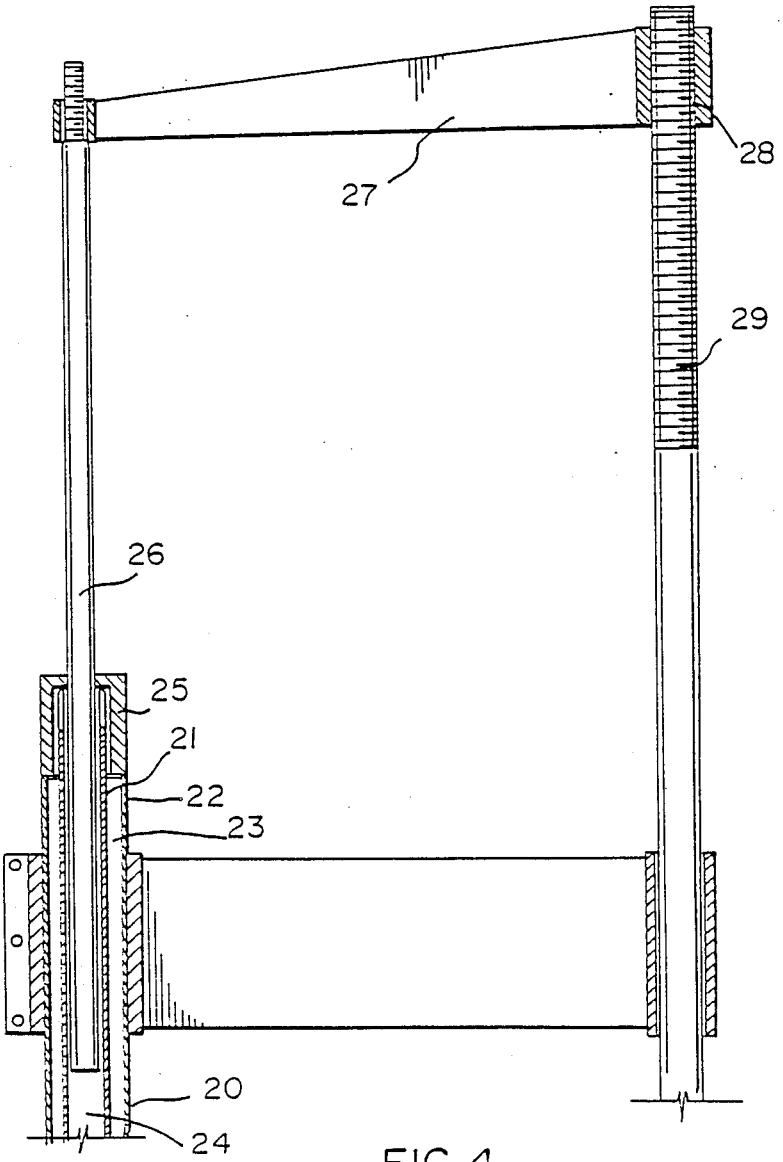
FIG. 4 is a continuation of the upper end of FIG. 3.

The injection tool is illustrated in FIGS. 2 to 4 and consists basically of a drive unit 10, a casing 20 having a variable volume chamber therein for holding a supply of a filler material having a radioactive tracer element evenly distributed therethrough, a metering unit 30 for metering the outflow of filler material from the chamber of casing 20 and a line 40 for coupling to a line carrying the material being pumped underground.

Drive unit 10 consists of a hydraulic motor 11 driving a reduction gear box 12 by a shaft 13 having a rubber flexible coupling 14 therein. A gear 15 is mounted on the shaft 13 to rotate therewith and drive a gear 16 of a rotary pulse generator 17 having an output signal line 18. The gear box 12 has two output shafts designated respectively 19 and 19A.

The casing 20 comprises a pair of respective inner and outer metal tubes 21 and 22 radially spaced from one another and the space therebetween is filled with lead 23. The interior of the casing provides a chamber 24 for holding a plug form of radioactive material distributed evenly throughout a filler. The plugs are a solid organic chemical mixture with a precise amount of radioactive material evenly distributed therethrough and can be ground into a particle size equivalent of, for example, a 20/40 mesh sand. The solid chemical mixture provides a low specific gravity similar to the treating fluid yet has the physical characteristics similar to sand used in oil/-gas well stimulation processes such as fracturing and acid in cement squeezes. The solid particles to which the radioactive materials are chemically bonded have excellent leaching properties when they enter the formation and thus there is no danger of flow back of radioactive materials to surface in detectable amounts. These particles travel with the fluid during fracturing, therefore, there is far less chance of any radioactive material falling into the bottom of the well bore and being trapped in the casing or tubing collars.

The lead-lined casing 20 has, at the top end thereof, a screw-on cap 25 through which a plunger 26 projects to vary the volume of the chamber 24. The plunger 26 is progressively forced into the chamber 24 by an arm 27 threaded as at 28 onto a screw shaft 29 driven for rotation by output shaft 19A of the gear box. A microswitch 50 is associated with the rotatable shaft 29 (notch on shaft and finger on switch) to trigger a counter for each revolution of the shaft. A turn counter TC is located in a portable case PC used by the operator at some location remote from the injector 10. Knowing the number of turns and the number of threads per inch on shaft 29, the distance of travel of the plunger 26 into the chamber 24 is readily determined. With this, along with an R.P.M. indicator RPM1, one can determine the change of volume of the chamber 24 which provides the rate of the consumption of the plug and thus the amount of radioactive material being added. Micro switch 50 and rotary pulse generator 17 are connected by suitable conductors to the instruments in the portable case PC by a quick disconnect coupling DC.

In the embodiment illustrated in FIG. 2 the metering unit 30 is a grinder and mixer driven by way of the gear box output shaft 19 through a rubber flexible disconnect coupling 18A. The unit 30 has a passageway 31 for the plug in chamber 24 and the leading end of the plug engages a grinding or auger shaft 32 driven by the shaft 19 and located in a mixing and grinding chamber 33. The auger 32, located at the bottom end of the passage 31, grinds off the leading end of the plug in proportional amounts as the plunger shaft 26 pushes the plug into the auger. Revolutions of the auger 32 per minute and cumulative turns of the screw shaft 29 determines how fast the plug is fed and the rate at which it is ground which can be varied by controlling the speed of the motor in any suitable manner. The radioactive material that is ground off is deposited in the stream of fluids going through the frac line L2 which is detachably connectable through couplings 40A and 40B to the conduit 40. The chamber 33 communicates with the interior of the conduit 40 through an aperture 41 in the wall of the conduit, chamber 33 being provided by a rigid housing 34 rigidly attached to the conduit 40. Suitable caps (not shown) are provided that thread onto the respective couplings when the injector is not in use.

To facilitate the required portability of the injector, the various components are detachably interconnected. As previously mentioned, the metering unit is rigidly mounted on conduit 40 and, as will be seen in the drawings, a flat bar 70 is secured to and projects laterally from such conduit. The hydraulic motor 11 and gear box 12 are mounted on a base plate 71 having a channel 72 in the bottom thereof that slidably receives therein the bar 70. As previously mentioned, coupling 18A is a quick disconnect type. The gear box and motor are enclosed by a cover 80 provided with a carrying handle 82. Casing 20 is connected to the housing 34 of the metering unit 30 by a quick disconnect coupling 20A and thread rod 29 is connected to shaft 19A of the gear reduction unit by a quick disconnect coupling 29A.

I claim:

1. A method of adding minute quantities of radioactive material to frac material being pumped underground comprising (a) providing, in solid plug form, a filler material having a minor portion of radioactive material distributed evenly therethrough, (b) providing a lead shielded container for said solid plug of filler and radioactive material, (c) reducing said solid plug into particles and metering outflow of said filler and radioactive material from the container at a selected rate in its particulate form, and (d) directing said metered outflow of particle form material into the frac material as it is being pumped.

2. The method as defined in claim 1 wherein metering the outflow of filler and radioactive material comprises grinding said plug into particles at a selected rate.

3. A method of adding a radioactive tracer material to a flowing stream of frac material being pumped underground comprising (a) providing in solid plug form a filler material having as a minor portion thereof a radioactive material distributed evenly therethrough, (b) providing a lead shielded container for said solid plug of filler and radioactive material, (c) determining the flow rate of said stream of frac material, (d) reducing said solid plug into particles and metering outflow of said filler and radioactive material from the container at a selected rate dependent upon said flow rate of the frac material to provide the desired concentration of radioactive material in the flowing frac material, and (e) injectivg said filler, having radioactive material therein, during metering thereof directly into the flowing stream of frac material as it is being pumped.

4. Apparatus for injecting minute quantities of radioactive material into frac material being pumped by a primary pumper through a pressure line comprising:

(a) a lead shielded chamber for holding a solid plug of filler material having a radioactive tracer element evenly distributed therethrough;

(b) a grinder for grinding said plug into particles of selected size (c) means for progressively decreasing the volume of said chamber at a predetermined rate to feed a plug in said chamber to said grinder and thereby provide particulate materials at a metered rate, and (d) means for directing said particulate material at said metered rate into said pressure line.

5. Apparatus as defined in claim 4, wherein said variably volume chamber is provided by a cylinder having a plunger reciprocally mounted therein.

6. Apparatus as defined in claim 5, wherein said plunger is driven into said cylinder by a power driven screw feed.

7. Apparatus for injecting a tracer material into a stream of material flowing through a conduit comprising (a) a casing having a mixing chamber therein and an outlet therefrom adapted to be connected in fluid flow communication with said conduit;

(b) a power driven grinding element located in said mixing chamber;

(c) power driven feed means for progressively moving a solid plug of tracer containing material into engagement with said grinding element; and (d) means co-relating driving of said grinding element and rate of movement of the power feed means to produce ground material of selected size and at a selected rate for feeding into said conduit.

8. Apparatus as defined in claim 7, including means co-relating to the rate of flow of material through said conduit with the rate of production of the ground material containing the tracer element thereby providing a consistent and selected concentrate of tracer element in frac material flowing through said conduit.

9. Apparatus as defined in claim 7, wherein said grinding element and plug feed means are driven by a common power source.

10. Apparatus as defined in claim 9, wherein said plug feed means comprises a plunger connected to a screw feed means.

11. A method of adding minute quantities of radioactive trace material to frac material being pumped underground comprising (a) providing a solid plug comprising a filler material and a minor portion of a radioactive material, said radio active material being distributed evenly throughout said plug;

(b) providing a lead shielded container for said filler and radioactive material, (c) reducing said solid plug to particle form at a selected rate and thereby controllably metering said filler and radioactive material from the container, and (d) directing said filler and radioactive material, in said particle form, into the frac material at said selected rate as said frac material is being pumped.

12. The method as defined in claim 11, wherein said metering comprising grinding said plug into particles at a selected rate as the plug is progressively driven at a selected rate from said container.

13. A method of adding a radioactive tracer material to a flowing stream of material being pumped underground comprising (a) determining the flow rate of said stream of material;

(b) providing in solid plug form a filler material having a minor quantity of radioactive material evenly distributed therethrough;

(c) reducing said solid plug into particles at a rate co-related to said flow rate to provide a desired concentration of radioactive material in the flowing material, and (d) directing said particulate form filler having the radioactive material therein, directly into the flowing stream as the plug is being reduced to particle form.

14. Apparatus for injecting minute quantities of radioactive material into frac material being moved through a conduit into the ground by a pumper comprising (a) a lead shielded chamber for holding solid plug filler material having a radioactive tracer element evenly distributed therethrough;

(b) means for progressively moving a plug of said material in said chamber at a predetermined rate through an outlet therefrom;

(c) means for removing, in particle form, material from the leading end of the plug as it advances from said chamber, and (d) means for use in directing the particulate material into said conduit.

15. Apparatus as defined in claim 14, wherein said means for removing, in particle form, material from the plug comprises a power driven cutter.

* * * * *